US011657955B2

(12) United States Patent
Watanabe et al.

(10) Patent No.: US 11,657,955 B2
(45) Date of Patent: May 23, 2023

(54) SURFACE MOUNT INDUCTOR

(71) Applicant: Murata Manufacturing Co., Ltd., Kyoto-fu (JP)

(72) Inventors: Ryota Watanabe, Nagaokakyo (JP); Masaki Kitajima, Nagaokakyo (JP); Takeo Ohaga, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 983 days.

(21) Appl. No.: 16/373,543

(22) Filed: Apr. 2, 2019

(65) Prior Publication Data

US 2019/0311841 A1 Oct. 10, 2019

(30) Foreign Application Priority Data

Apr. 10, 2018 (JP) ..... JP2018-075477
Dec. 5, 2018 (JP) ..... JP2018-228012

(51) Int. Cl.
*H01F 27/29* (2006.01)
*H01F 27/28* (2006.01)
(Continued)

(52) U.S. Cl.
CPC ..... *H01F 27/292* (2013.01); *H01F 17/04* (2013.01); *H01F 27/2828* (2013.01);
(Continued)

(58) Field of Classification Search
CPC ..... H01F 27/292; H01F 27/2828; H01F 27/2852; H01F 27/04; H01F 17/04; H01F 2017/048; H01F 27/255
See application file for complete search history.

(56) References Cited

U.S. PATENT DOCUMENTS

2009/0058588 A1* 3/2009 Suzuki ..... H01F 27/292 336/192
2011/0304421 A1* 12/2011 Chang ..... H01F 27/085 336/221
(Continued)

FOREIGN PATENT DOCUMENTS

CN 103339695 A 10/2013
CN 103680849 A 3/2014
(Continued)

OTHER PUBLICATIONS

An Office Action; "Notice of Reasons for Refusal," mailed by the Japanese Patent Office dated May 11, 2021, which corresponds to Japanese Patent Application No. 2018-228012 and is related to U.S. Appl. No. 16/373,543 with English language translation.

*Primary Examiner* — Livius R. Cazan
(74) *Attorney, Agent, or Firm* — Studebaker & Brackett PC

(57) ABSTRACT

A surface mount inductor includes a coil including a conducting wire winding portion with both ends on the outer circumference and a pair of extension portions that extend from the outer circumference, a molded body containing a metal magnetic powder and the coil embedded, and a pair of outer terminals disposed on the molded body and connected to the extension portions. The molded body has principal surfaces, end surfaces, and side surfaces. One principal surface serves as a mounting surface including a recessed portion with an elevated region and a lowered region. The coil is embedded in the molded body with the winding axis of the winding portion parallel to the recessed portion, and the pair of extension portions extend from the outer circumference toward the mounting surface to be exposed at the lowered region and connected to the pair of outer terminals in the lowered region.

14 Claims, 4 Drawing Sheets

(51) Int. Cl.
*H01F 17/04* (2006.01)
*H01F 41/06* (2016.01)

(52) U.S. Cl.
CPC ..... *H01F 27/2852* (2013.01); *H01F 41/06* (2013.01); *H01F 2017/048* (2013.01)

(56) References Cited

U.S. PATENT DOCUMENTS

| | | | | |
|---|---|---|---|---|
| 2013/0307655 | A1* | 11/2013 | Saito | H01F 27/292 336/83 |
| 2014/0062640 | A1 | 3/2014 | Sasamori et al. | |
| 2017/0150606 | A1* | 5/2017 | Yoon | H01F 17/0033 |
| 2019/0088397 | A1* | 3/2019 | Ohtsubo | H01F 27/24 |
| 2019/0252113 | A1* | 8/2019 | Ku | H01F 27/292 |

FOREIGN PATENT DOCUMENTS

| | | | | | |
|---|---|---|---|---|---|
| JP | S54-2142 | U | | 1/1979 | |
| JP | H11-288824 | A | | 10/1999 | |
| JP | 2009-267350 | A | | 11/2009 | |
| JP | 2009-295759 | A | | 12/2009 | |
| JP | 2010-147272 | A | | 7/2010 | |
| JP | 2012-160507 | A | | 8/2012 | |
| JP | 2013-149814 | A | | 8/2013 | |
| KR | 2014038781 | A | * | 3/2014 | H01F 1/22 |
| WO | 2017188102 | A1 | | 11/2017 | |
| WO | WO-2017188102 | A1 | * | 11/2017 | H01F 17/04 |

* cited by examiner

SURFACE MOUNT INDUCTOR

CROSS-REFERENCE TO RELATED APPLICATIONS

This application claims benefit of priority to Japanese Patent Application No. 2018-075477, filed Apr. 10, 2018, and Japanese Patent Application No. 2018-228012, filed Dec. 5, 2018 the entire contents of both are incorporated herein by reference.

BACKGROUND

Technical Field

The present disclosure relates to a surface mount inductor. In particular, the present disclosure relates to a surface mount inductor in which at least one coil is embedded in a molded body.

Background Art

Regarding surface mount inductors used for power inductors, for example, a surface mount inductor in which a coil formed by winding a conducting wire is embedded in a molded body containing a magnetic powder is used. In a known surface mount inductor, for example, a coil including a winding portion formed by winding a conducting wire such that both ends are located on the outer circumference and extension portions that extend from the outer circumference of the winding portion is used. The end portions of the extension portions of the coil extend to the side surfaces of the molded body, and the end portions of the extension portions are connected to outer terminals formed on the side surfaces and the mounting surface adjacent to the side surfaces of the molded body as described, for example, in Japanese Unexamined Patent Application Publication No. 2009-267350.

In recent years, power inductors used for power supply circuits have been required to have reduced sizes and reduced weights in accordance with size reduction and weight reduction of electronic apparatuses. In addition, so-called compatibility with high current is required such that a high current is allowed to flow at even a low voltage in accordance with a reduction in the power supply voltage. However, in the surface mount inductor in the related art, the end portions of the extension portions of the coil extend to the side surfaces of the molded body and are connected to the outer terminals on the side surfaces of the molded body. Consequently, current paths from connection portions of the outer terminals connected to the extension portions of the coil to the mounting surface of the molded body are required. As a result, there are problems in that a reduction in resistance for addressing a high current is difficult because the length of the current paths increases and electric resistance of the outer terminals increases. Meanwhile, when the end portions of the extension portions of the coil are exposed to the mounting surface, there is a problem in that the reliability of a product is degraded because processing of the end portions of extension portions of the coil becomes complex, the strength of the end portions of the extension portions is reduced, and variations in quality occur.

SUMMARY

Accordingly, the present disclosure provides a surface mount inductor in which the resistance can be reduced and the reliability can be improved.

To address the above-described problems, a surface mount inductor according to preferred embodiments of the present disclosure includes a coil including a winding portion formed by winding a conducting wire such that both ends are located on the outer circumference and a pair of extension portions that extend from the outer circumference of the winding portion; a molded body which contains a metal magnetic powder and in which the coil is embedded; and a pair of outer terminals disposed on the molded body and connected to the extension portions. The molded body has a pair of principal surfaces opposite to each other, a pair of end surfaces that are adjacent to the pair of principal surfaces and that are opposite to each other, and side surfaces that are adjacent to the pair of principal surfaces and the pair of end surfaces and that are opposite to each other. One of the principal surfaces serves as a mounting surface that includes a recessed portion so as to have an elevated region located at a relatively high position and a lowered region located at a relatively low position. The coil is embedded in the molded body such that the winding axis of the winding portion becomes parallel to the recessed portion of the mounting surface of the molded body, and the pair of extension portions extend from the outer circumference of the winding portion toward the mounting surface and are arranged so as to be exposed at the lowered region of the mounting surface and connected to the pair of outer terminals in the lowered region.

According to the above-described aspect, the distance between the extension portion of the coil and the outer terminal portion mounted on the substrate can be reduced. Therefore, the electric resistance of the outer terminal can be reduced, complex processing of the end portion of the extension portion of the coil is unnecessary and, thereby, the reliability can be improved.

In another aspect, the mounting surface includes a region connecting the elevated region to the lowered region, and the extension portions extend so as to be exposed at the region connecting the elevated region to the lowered region and at the lowered region. According to this aspect, the electric resistance of the connection portion between the extension portion of the coil and the outer terminal can be reduced and, in addition, the adhesion strength between the extension portion and the outer terminal and the adhesion strength between the outer terminal and the molded body can be improved.

In another aspect, the molded body has end surfaces adjacent to the mounting surface, and the outer terminals are arranged so as to extend from the lowered region to the end surfaces. According to this aspect, the adhesion strength between the molded body and the outer terminal can be further improved.

In another aspect, the extension portions are also exposed at the end surfaces of the molded body, and the extension portions are also connected to the outer terminals on the end surfaces of the molded body. According to this aspect, the connection area between the extension portion of the coil and the outer terminal increases. Therefore, the electric resistance of the connection portion between the extension portion of the coil and the outer terminal can be further reduced and, in addition, the adhesion strength between the extension portion and the outer terminal can be improved.

In another aspect, the outer terminals extend along the region connecting the elevated region to the lowered region and along the lowered region. According to this aspect, the adhesion strength between the molded body and the outer terminal can be further improved.

In another aspect, L1 is equal to L2, where the direction in which the pair of end surfaces are opposite to each other is denoted as an L-direction. The length in the L-direction of the extension portion in the lowered region is denoted as L1, and the length in the L-direction of the outer terminal in the lowered region is denoted as L2. According to this aspect, the connection area between the extension portion and the outer terminal increases. Therefore, the electric resistance of the connection portion between the extension portion and the outer terminal can be further reduced.

In another aspect, L2 is more than L1, where the direction in which the pair of end surfaces are opposite to each other is denoted as an L-direction. The length in the L-direction of the extension portion in the lowered region is denoted as L1, and the length in the L-direction of the outer terminal in the lowered region is denoted as L2. According to this aspect, the connection area between the outer terminal and the molded body increases. Therefore, the adhesion strength between the outer terminal and the molded body can be improved.

Other features, elements, characteristics and advantages of the present disclosure will become more apparent from the following detailed description of preferred embodiments of the present disclosure with reference to the attached drawings.

DETAILED DESCRIPTION

Figure 1:
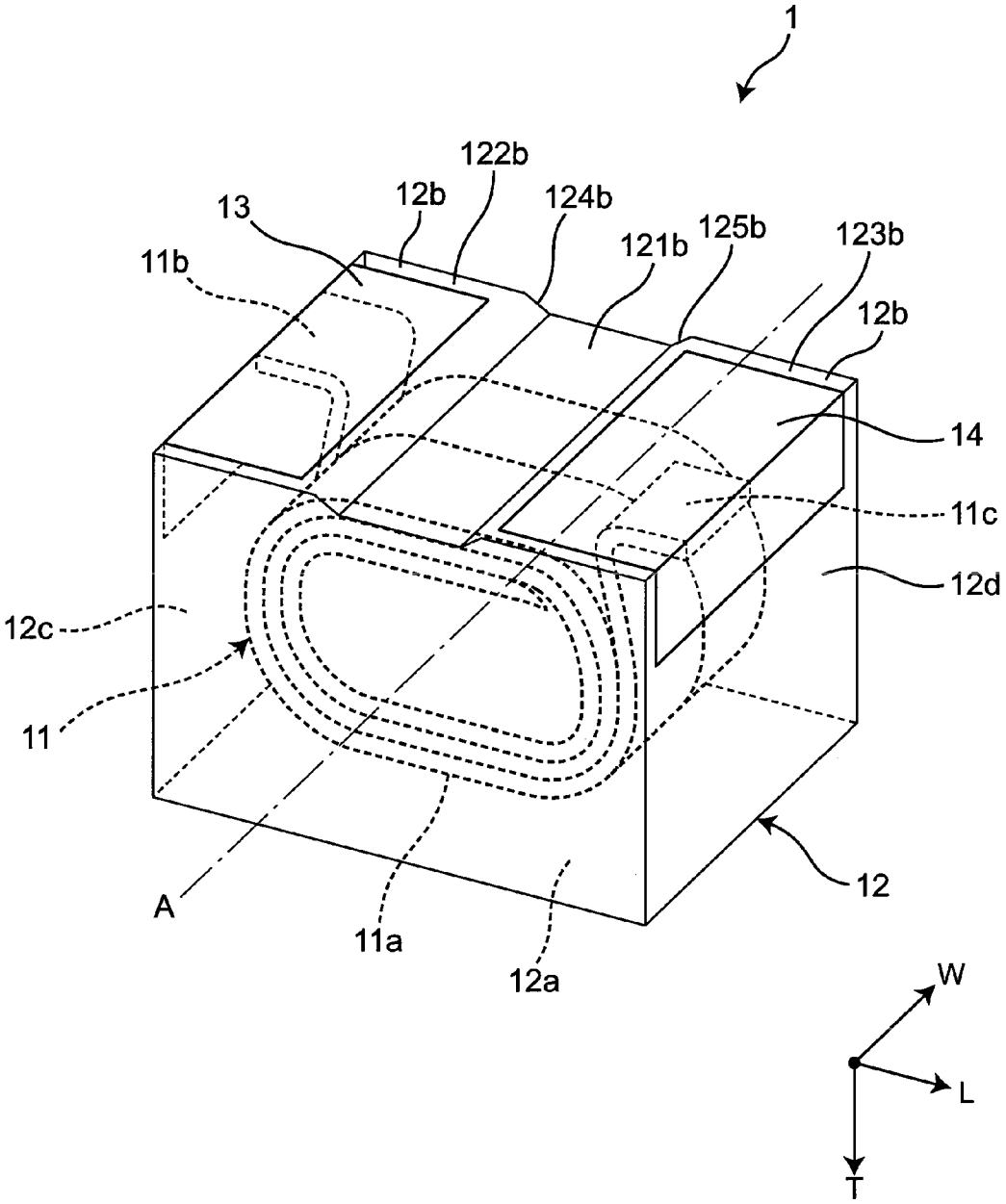
FIG. 1 is a schematic perspective view showing a surface mount inductor according to a first embodiment.

The embodiments according to the present disclosure will be described below with reference to the drawings and the like. Regarding drawings hereafter, the same members are indicated by the same reference numerals and explanations thereof may be omitted or simplified.

First Embodiment

A surface mount inductor according to the present embodiment includes a coil including a winding portion formed by winding a conducting wire around a winding axis and extension portions that extend from the outer circumference of the winding portion, a molded body which contains a magnetic powder and in which the coil is embedded, and outer terminals disposed on the molded body. The molded body has a pair of principal surfaces opposite to each other, a pair of end surfaces that are adjacent to the pair of principal surfaces and that are opposite to each other, and side surfaces that are adjacent to the pair of principal surfaces and the pair of end surfaces and that are opposite to each other. One of the principal surfaces serves as a mounting surface that includes a recessed portion so as to have an elevated region located at a relatively high position and a lowered region located at a relatively low position. The coil is embedded in the molded body such that the winding axis of the winding portion becomes parallel to the recessed portion of the mounting surface of the molded body. The end portions of the extension portions that extend from the winding portion of the coil toward the mounting surface are arranged so as to be exposed at the lowered region of the mounting surface and connected to the outer terminals in the lowered region.

FIG. 1 is a schematic perspective view showing a surface mount inductor 1 according to the present embodiment when viewed from the mounting surface side. The surface mount inductor 1 includes a molded body 12 composed of a sealing material containing a magnetic powder and a resin, and a coil 11 formed by winding a conducting wire is embedded in the molded body 12. FIG. 1 shows an example in which the molded body 12 is a substantially rectangular parallelepiped. The molded body 12 has an upper surface 12*a* and a bottom surface as a pair of principal surfaces opposite to each other. The bottom surface corresponds to a mounting surface 12*b*. In addition, the molded body 12 has a pair of end surfaces 12*c* and 12*d* that are adjacent to the upper surface 12*a* and the mounting surface 12*b* and that are opposite to each other and has side surfaces that are adjacent to the upper surface 12*a*, the mounting surface 12*b*, and the pair of end surfaces 12*c* and 12*d* and that are opposite to each other. The coil 11 is an air core coil and includes a winding portion 11*a* in which the conducting wire is wound in two stages while the inner circumferences are connected to each other, and both ends of the conducting wire are located on the outer circumference of the coil and a pair of extension portions 11*b* and 11*c* that extend from the outer circumference of the winding portion 11*a* in directions opposite to each other. The coil 11 is embedded in the molded body 12 such that the winding axis A of the winding portion 11*a* becomes parallel to the mounting surface 12*b* of the molded body. A flat type wire having a substantially rectangular cross section may be used for the conducting wire.

The mounting surface 12*b* of the molded body 12 has a groove-like recessed portion that extends parallel to the winding axis A of the winding portion of the coil 11 and has a first region 121*b* that is composed of the bottom surface of the recessed portion and that is located at a relatively high position, a second region 122*b* and a third region 123*b* that are located on both sides of the first region 121*b* such that the first region 121*b* is arranged therebetween and that are located at relatively lower positions (at positions lower than the first region 121*b*), a fourth region 124*b* that connects the first region 121*b* to the second region 122*b* and that is composed of the side surface of the recessed portion, and a fifth region 125*b* that connects the first region 121*b* to the third region 123*b* and that is composed of the side surface of the recessed portion. The fourth region 124*b* and the fifth region 125*b* are disposed between the first region 121*b* and the second region 122*b* and between the first region 121*b* and the third region 123*b*, respectively, while being gently inclined. One extension portion 11*b* extends from the outer circumference of the winding portion 11*a* through the molded body 12 and is bent such that the end portion is exposed at the second region 122*b* of the mounting surface 12*b*. The other extension portion 11*c* also extends from the outer circumference of the winding portion 11*a* through the molded body 12 and is bent such that the end portion is exposed at the third region 123*b* of the mounting surface 12*b*. Further, the extension portion 11*b* exposed at the second region 122*b* is connected to a first outer terminal 13, and the extension portion 11*c* exposed at the third region 123*b* is connected to a second outer terminal 14. In this regard, the fourth region 124*b* and the fifth region 125*b* may be substantially perpendicularly disposed between the first region 121*b* and the second region 122*b* and between the first region 121*b* and the third region 123*b*, respectively.

Figure 2:
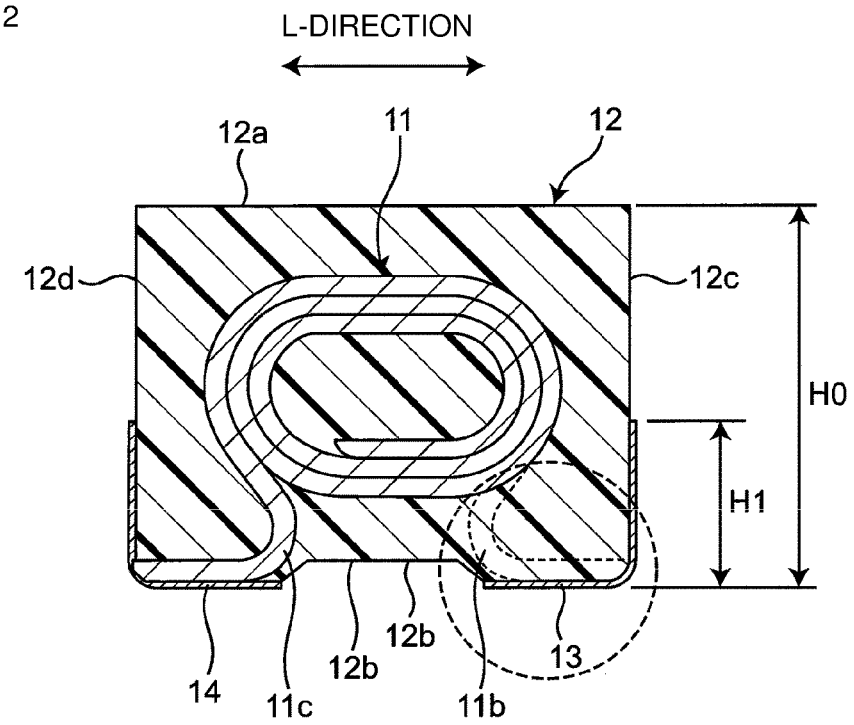
FIG. 2 is a schematic vertical sectional view of the surface mount inductor shown in FIG. 1.
Figure 3:
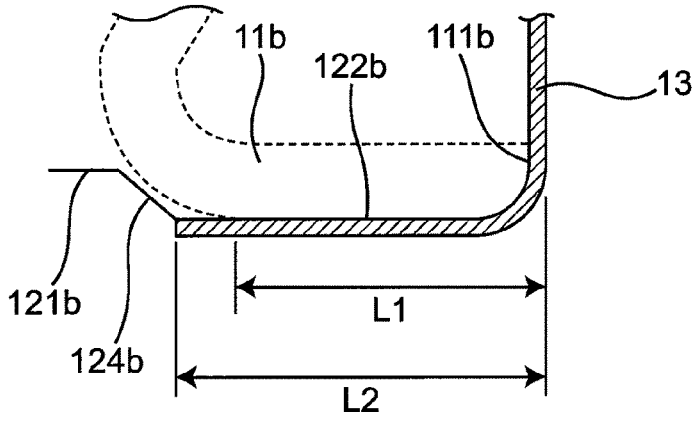
FIG. 3 is a schematic vertical sectional view showing a magnified part of FIG. 2.

FIG. 2 is a schematic vertical sectional view of the surface mount inductor 1 shown in FIG. 1 and shows an example with the mounting surface at the bottom. FIG. 3 is a schematic sectional view showing a magnified part of FIG. 2 and shows the relationship between the extension portion and the outer terminal. The relationship between the extension portion and the outer terminal will be described with reference to the extension portion 11*b*. The bent extension portion 11*b* extends toward the mounting surface 12*b*, extends along the fourth region 124*b*, and is exposed at the second region 122*b* and, in addition, the top end surface 111*b* of the extension portion 11*b* is arranged so as to be exposed at the end surface 12*c* adjacent to the mounting surface 12*b*. Meanwhile, the first outer terminal 13 extends from the second region 122*b* of the mounting surface 12*b* to part of the end surface 12*c* adjacent to the mounting surface 12*b* so as to have a substantially L-shaped cross section and is connected to the extension portion 11*b* exposed at the second region 122*b* and the end surface 12*c*.

The molded body 12 is formed of a sealing material containing a magnetic powder and a resin. Examples of the magnetic powder include metal magnetic powders with an iron base of, for example, Fe, Fe—Si, Fe—Si—Cr, Fe—Si—Al, Fe—Ni—Al, or Fe—Cr—Al, metal magnetic powders of an iron-free composition base, metal magnetic powders of another iron-containing composition base, metal magnetic powders in an amorphous state, metal magnetic powders having a surface covered with an insulator, for example, glass, metal magnetic powders having a modified surface, and fine nano-level metal magnetic powders and mixtures of these. Examples of the resin include thermosetting resins, for example, an epoxy resin, a polyimide resin, and a phenol resin, and thermoplastic resins, for example, a polyethylene resin and a polyamide resin, and mixtures of these. There is no particular limitation regarding the size of the molded body 12 as long as the size is suitable for surface mounting. For example, the size may be L (length) of about 2.5 mm×W (width) of about 2.0 mm×T (height) of about 2.0 mm. In the case in which the size of the molded body 12 is L (length) of about 2.5 mm×W (width) of about 2.0 mm×T (height) of about 2.0 mm, the depth of the recessed portion that is the distance from the first region 121*b* to the second region 122*b* or the third region 123*b* is, for example, about 50 μm or more.

The surface mount inductor according to the present embodiment may be produced by using, for example, the following manufacturing method. The winding portion 11*a* shown in FIG. 1 is formed by spirally winding a flat type conducting wire that is provided with an insulating cover and that has a substantially rectangular cross section in two stages while both ends of the conducting wire along the outer circumference are located opposite to each other and the inner circumferences are connected to each other. Subsequently, both ends of the conducting wire extend from opposing sides of the outer circumference of the winding portion toward the mounting surface and are bent in opposing directions so as to form the extension portions 11*b* and 11*c* and to form the coil 11. Preferably, the resin used for the insulating cover has high heat resistance, and examples include a polyamide-based resin, a polyester-based resin, and an imide-modified-polyurethane resin. Regarding the conducting wire, a round wire having a substantially circular cross section or a wire having a substantially polygonal cross section may be used.

Next, a sealing material (hereafter referred to as a molded body material) is produced by mixing a metal magnetic powder and a resin. Examples of the metal magnetic powder include metal magnetic powders with an iron base of, for example, Fe, Fe—Si—Cr, Fe—Si—Al, Fe—Ni—Al, or Fe—Cr—Al, metal magnetic powders of an iron-free composition base, metal magnetic powders of another iron-containing composition base, metal magnetic powders in an amorphous state, metal magnetic powders having a surface covered with an insulator, for example, glass, metal magnetic powders having a modified surface, and fine nano-level metal magnetic powders. Examples of the resin include thermosetting resins, for example, an epoxy resin, a polyimide resin, and a phenol resin, and thermoplastic resins, for example, a polyethylene resin and a polyamide resin. The molded body material is used, and a preliminary molded body is produced in advance so as to include a bottom portion, a winding shaft portion disposed on the bottom portion for the purpose of inserting the winding portion, and a wall portion disposed on the bottom portion to surround the winding shaft portion, while notches for extension of the extension portions are formed in the wall portion. The coil 11 is attached to the preliminary molded body such that the extension portions are arranged along the outer side portion of the wall portion of the preliminary molded body. This is placed in a predetermined mold such that the winding axis becomes parallel to the mounting surface of the molded body, the mold being capable of providing the mounting surface with a recessed portion. In addition, another preliminary molded body is placed in the mold or the mold is filled with the molded body material, and these are compression-molded. Consequently, as shown in FIG. 1, the molded body 12 in which the coil 11 is embedded and the mounting surface 12*b* has the recessed portion is obtained. The molding method is not limited to such a compression-molding method, and a compacting method may be used.

Subsequently, a resin component present on the surface of the portions, on which the outer terminals are to be formed, of the mounting surface 12*b* of the molded body 12 is removed by using a resin removal measure, for example, laser irradiation, blast treatment, polishing, or the like. Consequently, regions at which the metal magnetic powder is exposed are formed in the mounting surface 12*b* of the molded body 12. In addition, the insulation cover of the end portions of the extension portions 11*b* and 11*c* of the coil 11 are removed by using the resin removal measure so as to expose the conducting wire.

Further, the molded body 12 is subjected to plating treatment so as to grow plating on the regions at which the metal magnetic powder is exposed and on the conducting wire of the mounting surface 12*b* of the molded body 12, thereby, forming the first outer terminal 13 and the second outer terminal 14. As a result, the first outer terminal 13 is connected to the extension portion 11*b* of the coil 11, and the second outer terminal 14 is connected to the extension portion 11*c* of the coil 11. In this regard, the first outer terminal 13 and the second outer terminal 14 are formed on the region at which the metal magnetic powder is exposed and on the conducting wire of the mounting surface 12*b* of the molded body 12 by forming a first plating layer of Cu, forming thereon a second plating layer of Ni, and forming thereon a third plating layer of Sn. There is no particular limitation regarding the conductive material used for plating as long as the conductor is suitable for plating, and conductors other than Cu, Ni, and Sn, for example, silver and alloys containing silver, may be used. The order of the conductors used may be changed in accordance with the characteristics. The first outer terminal 13 and the second outer terminal 14 may be composed of a single layer, two layers, or three or more layers.

According to the present embodiment, the extension portion of the coil can extend directly to the mounting surface and be connected to the outer terminal and, therefore, the distance between the extension portion of the coil and the portion that is mounted on the substrate of the outer terminal is reduced. Consequently, the resistance of the surface mount inductor can be reduced by reducing the electric resistance of the outer terminal. For example, in the related art, the direct current resistance of the surface mount inductor, in which the end portions of the extension portions of the coil extend to the side surfaces of the molded body, outer terminals are disposed on the side surfaces of the molded body and the mounting surface adjacent to the side surfaces, and the end portions of the extension portions of the coil are connected to the outer terminals, is 6.15 mΩ, whereas in the present embodiment, the direct current resistance of the inductor can be reduced to 4.88 mΩ. According to the present embodiment, the coil is embedded in the molded body such that the winding axis of the coil becomes parallel to the mounting surface of the molded body. Therefore, when the end portion of the extension portion extends to the mounting surface, processing for deforming the end portion of the extension portion to a great extent is unnecessary. For example, when the coil is embedded in the molded body such that the winding axis of the coil becomes perpendicular to the mounting surface of the molded body, as in the related art, complex processing such as twisting, crushing, or the like to deform the extension portion to a great extent is required for the extension portion to extend to the mounting surface. As a result, the mechanical strength of the extension portion may be reduced so as to cause breakage, or variations in the quality may occur. According to the present embodiment, processing for deforming the end portion of the extension portion to a great extent is unnecessary and, therefore, the reliability of the product can be improved. Meanwhile, the mounting surface of the molded body has the recessed portion and, thereby, the creepage distance between the first outer terminal and the second outer terminal can be increased by an amount corresponding to the side surfaces of the recessed portion located between the first region and the second region and between the first region and the third region (the fourth region and the fifth region) compared with the case in which the recessed portion is not present. Therefore, a short circuit between the outer terminals can be suppressed. Consequently, the withstand voltage of the surface mount inductor can be improved. In addition, the mounting surface of the molded body has the recessed portion, thereby suppressing the substrate from coming into direct contact with the mounting surface of the molded body, even when the substrate is bent. Consequently, the influence of bending or vibration of the substrate is reduced, thereby improving the reliability of the surface mount inductor. Meanwhile, in the case in which the surface mount inductor is mounted by being temporarily fixed to the substrate by using an adhesive, the recessed portion can be used as a space filled with the adhesive. Therefore, the adhesion strength between the mounting surface and the substrate can be improved, and the reliability of the surface mount inductor can be further improved.

The present embodiment shows an example in which the mounting surface has the groove-like recessed portion that is disposed parallel to the winding axis of the coil, and the second region and the third region that are located at relatively lower positions are formed on both sides of the first region located at a relatively high position such that the first region is arranged therebetween, but the present disclosure is not limited to this. For example, the mounting surface may have a recessed portion and a relatively lowered region may be disposed so as to surround a relatively elevated region composed of the bottom surface of the recessed portion. Alternatively, the recessed portion may be circular in top view. The sizes of the second region and the third region (i.e., areas on the mounting surface) may be the same or different from each other.

In the present embodiment, the top end surface of the extension portion 11*b* of the coil 11 is not necessarily exposed at the end surface 12*c* adjacent to the mounting surface 12*b*, but it is preferable that the top end surface be arranged so as to be exposed at the end surface 12*c* adjacent to the mounting surface 12*b*, as shown in FIGS. 2 and 3. The exposure area of the extension portion of the coil can increase. Therefore, the adhesion strength between the extension portion of the coil and the outer terminal can be improved and, in addition, the adhesion strength between the outer terminal and the molded body can be improved.

In the present embodiment, the outer terminals have to be disposed on at least the mounting surface, and it is preferable that each of the outer terminals extend from the mounting surface to the end surface adjacent to the mounting surface so as to have a substantially L-shaped cross section, as shown in FIGS. 1 and 2. The adhesion strength between the outer terminal and the molded body can be further enhanced. When the end portion of the extension portion of the coil is exposed at the end surface, the connection area between the extension portion and the outer terminal can be increased by forming the outer terminal so as to have a substantially L-shaped cross section and, therefore, the resistance between the extension portion and the outer terminal can be further reduced. In the case in which the outer terminal has a substantially L-shaped cross section, the height H1 of the portion that extends on the end surface, as shown in FIG. 2, is preferably a quarter or more of the height HO of the molded body 12 and more preferably a quarter or more and a half or less from the viewpoint of the adhesion strength and the resistance reduction. When the end portion of the extension portion of the coil is exposed at the end surface, it is preferable that the length of the end surface portion of the outer terminal be equal to the length of the mounting surface portion.

Figure 4:
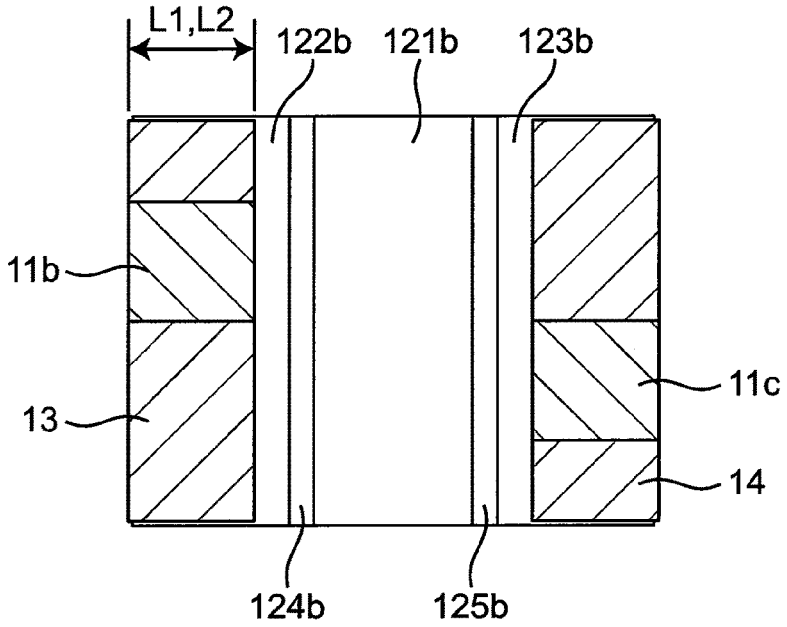
FIG. 4 is a bottom view showing another example of the surface mount inductor according to the first embodiment.

As shown in FIG. 1, the molded body 12 has a pair of end surfaces 12*c* and 12*d* that are in contact with the mounting surface 12*b*, that are a pair of end surfaces opposite to each other, and that are arranged in a direction orthogonal to the winding axis A. As shown in FIGS. 2 and 3, L1 may be equal to L2, where the direction in which the pair of end surfaces 12*c* and 12*d* are opposite to each other is denoted as an L-direction, the length in the L-direction of the extension portion 11*b* in the second region 122*b* is denoted as L1, and the length in the L-direction of the outer terminal 13 in the second region 122*b* is denoted as L2. FIG. 4 shows an example thereof. FIG. 4 is a bottom view showing an example of the surface mount inductor 1 and shows the state of the mounting surface. The lengths in the L-direction of the extension portion 11*b* and the extension portion 11*c* are the same as the lengths in the L-direction of the first outer terminal 13 and the second outer terminal 14, respectively.

The electric resistance between the extension portion and the outer terminal can be further reduced by increasing the connection area between the extension portion and the outer terminal.

Figure 5:
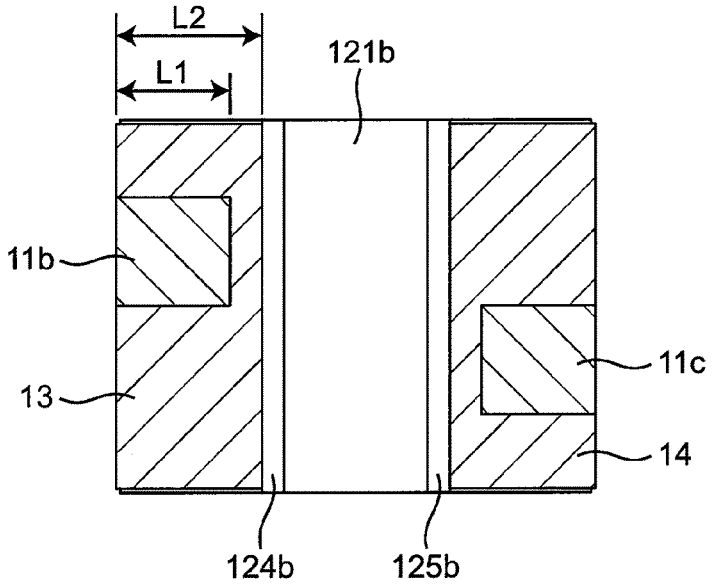
FIG. 5 is a bottom view showing another example of the surface mount inductor according to the first embodiment.

On the other hand, as shown in FIG. 5, the lengths in the L-direction of the first outer terminal 13 and the second outer terminal 14 may be more than the lengths in the L-direction of the extension portion 11*b* and the extension portion 11*c*, respectively. In this case, the adhesion strength between the molded body and the outer terminal can be improved.

FIGS. 4 and 5 show examples in which the lengths in the L-direction of the extension portion 11*b* and the extension portion 11*c* are the same and the lengths in the L-direction of the first outer terminal and the second outer terminal are the same. However, the lengths in the L-direction of the extension portion 11*b* and the extension portion 11*c* may be different from each other, and the lengths in the L-direction of the first outer terminal and the second outer terminal may be different from each other.

Second Embodiment

The present embodiment has the same configuration as the first embodiment except that the extension portions of the coil extend so as to be exposed at the fourth region and the fifth region and be exposed at the second region and the third region of the mounting surface.

Figure 6:
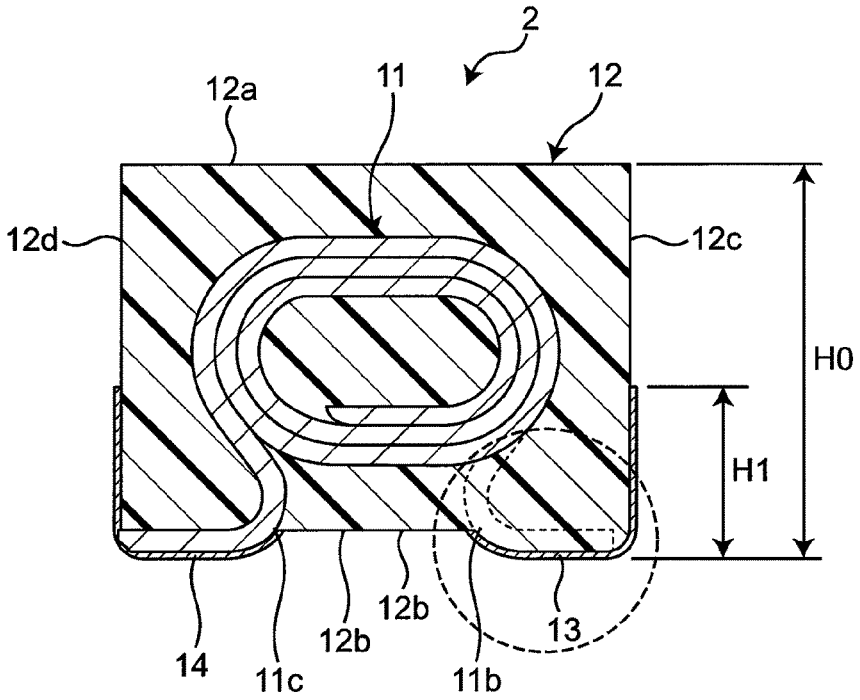
FIG. 6 is a schematic vertical sectional view of a surface mount inductor according to a second embodiment.
Figure 7:
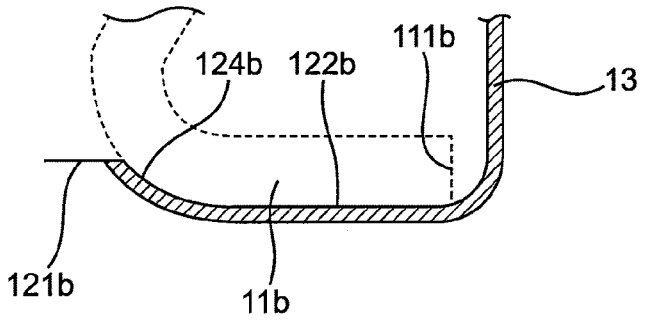
FIG. 7 is a schematic vertical sectional view showing a magnified part of FIG. 6.

FIG. 6 is a schematic vertical sectional view of a surface mount inductor 2 according to the present embodiment and shows an example with the mounting surface at the bottom. FIG. 7 is a schematic vertical sectional view showing a magnified part of FIG. 6 and shows the relationship between the extension portion and the outer terminal. The relationship between the extension portion and the outer terminal will be described with reference to the extension portion 11*b*. The bent extension portion 11*b* extends toward the mounting surface 12*b* and is arranged so as to be exposed at the fourth region 124*b* and the second region 122*b*. Meanwhile, the first outer terminal 13 extends from the fourth region 124*b* to the second region 122*b* and part of the end surface 12*c* adjacent to the mounting surface 12*b* so as to have a substantially L-shaped cross section and is connected to the extension portion 11*b* exposed at the fourth region 124*b* and the second region 122*b*.

According to the present embodiment, the following effects are exerted because the extension portion is exposed at the fourth region. When the molded body is molded, positioning of the coil in the mold is performed by using the position of the recessed portion disposed in the mold as the reference of arrangement. Therefore, positioning of the coil in the mold is readily performed and positional accuracy of the end portion of the extension portion of the coil in the molded body can be improved. In addition, the exposure area of the extension portion can be increased by exposing the extension portion at the fourth region. Consequently, the adhesion strength between the extension portion and the outer terminal can be further improved and, in addition, the electric resistance between the outer terminal and the extension portion can be further reduced. The adhesion strength between the outer terminal and the molded body can be further improved. The adhesion strength to the substrate can be further improved because solder fillet is formed on not only the end-surface side of the outer terminal but also the recessed-portion side of the outer terminal during mounting on the substrate.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A surface mount inductor comprising:

a coil including a winding portion formed by winding a conducting wire, such that both ends are located on the outer circumference, and a pair of extension portions that extend from the outer circumference of the winding portion;

a molded body which contains a metal magnetic powder and in which the coil is embedded; and a pair of outer terminals disposed on the molded body and connected to the extension portions, wherein the molded body has a pair of principal surfaces opposite to each other, a pair of end surfaces that are adjacent to the pair of principal surfaces and that are opposite to each other, and side surfaces that are adjacent to the pair of principal surfaces and the pair of end surfaces and that are opposite to each other, one of the principal surfaces serving as a mounting surface that is a lowest surface of the molded body that includes a recessed portion so as to have an elevated region located at a relatively high position and a pair of lowered regions located at a relatively low position on both sides of the recessed portion, the pair of lowered regions connecting the side surfaces to each other, the coil is embedded in the molded body such that the winding axis of the winding portion becomes parallel to the recessed portion of the mounting surface of the molded body, the pair of extension portions extend from the outer circumference of the winding portion toward the mounting surface and are arranged so as to be exposed at the pair of lowered regions of the mounting surface and connected to the pair of outer terminals in the pair of lowered regions, the mounting surface includes a pair of inclined regions connecting the elevated region to the pair of lowered regions, and the extension portions extend to be exposed at the pair of inclined regions connecting the elevated region to the pair of lowered regions and at the pair of lowered regions, and the pair of inclined regions connecting the elevated region to the pair of lowered regions are inclined to have slopes measured from the elevated region to the pair of lowered regions.

2. The surface mount inductor according to claim 1, wherein the molded body has end surfaces adjacent to the mounting surface, and the outer terminals are arranged so as to extend from the pair of lowered regions to the end surfaces.

3. The surface mount inductor according to claim 2, wherein the extension portions are also exposed at the end surfaces, and the extension portions are also connected to the outer terminals on the end surfaces.

4. The surface mount inductor according to claim 3, wherein the outer terminals extend along the pair of inclined regions connecting the elevated region to the pair of lowered regions and along the pair of lowered regions.

5. The surface mount inductor according to claim 3, wherein

L1 is equal to L2, where the direction in which the pair of end surfaces are opposite to each other is denoted as an L-direction, the length in the L-direction of the extension portion in each one of the pair of lowered regions is denoted as L1, and the length in the L-direction of the outer terminal in each one of the pair of lowered regions is denoted as L2.

6. The surface mount inductor according to claim 3, wherein

L2 is more than L1, where the direction in which the pair of end surfaces are opposite to each other is denoted as an L-direction, the length in the L-direction of the extension portion in each one of the pair of lowered regions is denoted as L1, and the length in the L-direction of the outer terminal in each one of the pair of lowered regions is denoted as L2.

7. The surface mount inductor according to claim 2, wherein the outer terminals extend along the pair of inclined regions connecting the elevated region to the pair of lowered regions and along the pair of lowered regions.

8. The surface mount inductor according to claim 2, wherein

L1 is equal to L2, where the direction in which the pair of end surfaces are opposite to each other is denoted as an L-direction, the length in the L-direction of the extension portion in each one of the pair of lowered regions is denoted as L1, and the length in the L-direction of the outer terminal in each one of the pair of lowered regions is denoted as L2.

9. The surface mount inductor according to claim 2, wherein

L2 is more than L1, where the direction in which the pair of end surfaces are opposite to each other is denoted as an L-direction, the length in the L-direction of the extension portion in each one of the pair of lowered regions is denoted as L1, and the length in the L-direction of the outer terminal in each one of the pair of lowered regions is denoted as L2.

10. The surface mount inductor according to claim 1, wherein the outer terminals extend along the pair of inclined regions connecting the elevated region to the pair of lowered regions and along the pair of lowered regions.

11. The surface mount inductor according to claim 10, wherein

L1 is equal to L2, where the direction in which the pair of end surfaces are opposite to each other is denoted as an L-direction, the length in the L-direction of the extension portion in each one of the pair of lowered regions is denoted as L1, and the length in the L-direction of the outer terminal in each one of the pair of lowered regions is denoted as L2.

12. The surface mount inductor according to claim 10, wherein

L2 is more than L1, where the direction in which the pair of end surfaces are opposite to each other is denoted as an L-direction, the length in the L-direction of the extension portion in each one of the pair of lowered regions is denoted as L1, and the length in the L-direction of the outer terminal in each one of the pair of lowered regions is denoted as L2.

13. The surface mount inductor according to claim 1, wherein

L1 is equal to L2, where the direction in which the pair of end surfaces are opposite to each other is denoted as an L-direction, the length in the L-direction of the extension portion in each one of the pair of lowered regions is denoted as L1, and the length in the L-direction of the outer terminal in each one of the pair of lowered regions is denoted as L2.

14. The surface mount inductor according to claim 1, wherein

L2 is more than L1, where the direction in which the pair of end surfaces are opposite to each other is denoted as an L-direction, the length in the L-direction of the extension portion in each one of the pair of lowered regions is denoted as L1, and the length in the L-direction of the outer terminal in each one of the pair of lowered regions is denoted as L2.

* * * * *